United States Patent [19]

Besnier

[11] Patent Number: 4,844,502

[45] Date of Patent: Jul. 4, 1989

[54] MONOSKI BINDING ARRANGEMENT

[75] Inventor: Bertrand Besnier, Annecy, France

[73] Assignee: Salomon S.A., Annecy Cedex, France

[21] Appl. No.: 138,708

[22] Filed: Dec. 28, 1987

[30] Foreign Application Priority Data

Feb. 18, 1987 [FR] France ..... 87 02598

[51] Int. Cl.[4] ..... A63C 9/00

[52] U.S. Cl. ..... 280/607; 280/629

[58] Field of Search ..... 280/607, 616, 617, 618, 280/625, 629

[56] References Cited

U.S. PATENT DOCUMENTS

| | | | |
|---|---|---|---|
| 3,802,714 | 4/1974 | Freegard | 280/607 |
| 3,929,344 | 12/1975 | Ott | 280/607 |
| 3,947,049 | 3/1976 | Pedersen | 280/607 |
| 4,652,007 | 3/1987 | Dennis | 280/618 |

FOREIGN PATENT DOCUMENTS 2728009 1/1979 Fed. Rep. of Germany .

*Primary Examiner*—Charles A. Marmor
*Assistant Examiner*—Michael Mar
*Attorney, Agent, or Firm*—Sandler & Greenblum

[57] ABSTRACT

A safety binding for securing two boots on a monoski. The binding includes a forward retention device adapted to retain the front of each boot from release upwardly from and laterally exteriorly of the monoski, and to free each boot front at least laterally when an excessive force is exerted by one of the boots on the forward retention device. The binding further includes a transverse linkage apparatus for linking the boots. This transverse linkage apparatus includes a central projecting wedge having a width substantially equal to the interior spacing of the soles of the boots in the position where the boots are inserted on the monoski. Each boot is retained at the level of its front end along a transverse direction towards the exterior of the monoski by the first retention device and towards the interior by the central wedge. The central wedge transmits to the other boot front interiorly directed transverse forces.

68 Claims, 6 Drawing Sheets

2
10
16
3
7
5
1
12
18
25
26
9
13
6
11
17
4
8

5
16
3
7
18
6
17
4
8

16
18
6
17
4

MONOSKI BINDING ARRANGEMENT

BACKGROUND OF THE INVENTION

1. Field of the Invention

The present invention relates to safety bindings for monoskis which are adapted to maintain two boots on a monoski.

2. Description of Background of Relevant Materials

Binding assemblies are known for traditional skis which are constituted by two principal elements, i.e, a front binding adapted to retain the front of the boot, and a rear binding adapted to retain the rear. These two front and rear bindings serve to free the end of the boot which they retain against the energy exerted by an elastic return system when the boot exerts a force which exceeds a predetermined threshold known as the release threshold.

It is these same binding assemblies which are likewise most often applied to monoskis, after possibly having undergone minor modifications. Thus, generally, a monoski is equipped with two front bindings mounted side by side and two rear bindings mounted side by side, each front or rear binding having its own release threshold.

For a pair of conventional skis, the bindings mounted on each ski are independent, and as a result, they independently release one boot or the other. On a single ski, the front binding and the rear binding are connected only by the fact that they retain the same boot, and as a result, if the boot is freed at one of its ends by release of the binding which retains it, it is automatically freed from the other binding.

As a result, when a skier falls, he may lose one of his ski, while the other ski stays attached to his other boot. For this to occur, it is necessary that only one of the boots exerts on the bindings of one ski forces which exceed the release threshold, and that the forces exerted by the other boot remain below the release threshold of the other boot's bindings.

While such a binding arrangement is acceptable in a traditional ski, where the skier can make use of the ski which remains attached to stop himself on the slope, this type of arrangement is dangerous with a monoski, where the monoski has a weight and inertia which is much more substantial than a conventional ski. Numerous monoski accidents occur because one of the boots of the skier is freed, as a result of excessive forces being exerted, but the other boot remains attached to the monoski since it has not itself biased the front and rear bindings which retain it beyond their release threshold.

One solution for overcoming this disadvantage consists of connecting the two boots together, for example at their front ends, in a manner such that when one of the boots leaves the front binding which retains it, the other front portion of the boot is likewise moved outside of its binding assembly.

By illustration of this approach, reference is made to French Patent Application No. 86 03854 belonging to Applicant.

Such an apparatus provides good results, but it requires a displacement of the front bindings on the monoski relative to their normal position.

Another solution described in French Patent Application No. 86 09637 consists of associating the movements of the two front bindings to one another in such a manner that as one of the jaws pivots laterally under the effect of a force exerted by the corresponding boot, the other jaw is released in a manner so as to be able to freely pivot and to allow for the liberation of the other boot.

Such an apparatus likewise gives good results, but it requires a front binding which is specifically made for a monoski.

SUMMARY OF THE INVENTION

It is, therefore, an object of the invention to provide a safety binding for securing two boots on a monoski. The binding comprises anterior retention means adapted to contain the front of each boot towards the top and exterior of the monoski and to free each front at least laterally when an excessive force is exerted by one of the boots on the first anterior retention means. The binding further comprises a transverse linkage apparatus for linking the boots. This transverse linkage apparatus comprises a central projecting wedge having a width substantially equal to the interior spacing of the soles of the boots in the position where the boots are inserted on the monoski. Each boot is retained at the level of its front end along a transverse direction towards the exterior of the monoski by the first retention means and towards the interior by the central wedge which further transmits to the other boot front interiorly directed transverse forces. As used in this application, the phrase "interiorly directed transverse forces" is intended to include forces having a component directed from one boot towards the other.

The linkage apparatus further comprises a transverse plate on which rests at least the front portion of each of the boots. The transverse plate itself is adapted to rest on the upper surface of the monoski and is moveable on the upper surface of the monoski at least along one direction component transverse to the longitudinal axis of the monoski. The central wedge may be rigidly affixed to the upper surface of the transverse plate along its longitudinal and vertical median plane.

Second retention means are provided for retaining the rear ends of the boots for freeing the rear ends of the boots in case of excessive force.

In one embodiment of the invention the first anterior retention means comprises front vertical retention means and exterior lateral retention means for each of the boots, whereby the lateral retention towards the interior is ensured by the central wedge of the linkage apparatus.

According to one embodiment of the invention, the transverse plate extends under the front portion of the sole of each boot. In another embodiment, the transverse plate extends under the boot from the front to the rear portion of the sole of each of the boots.

According to the invention elastic return means are provided for elastically returning the linkage apparatus to the centered position on the monoski.

Again, depending upon the embodiment, the transverse plate of the linkage apparatus may have a rearwardly extending arm which is pivotably mounted with respect to an axis which is rigidly affixed to the monoski. In another embodiment, the transverse plate of the linkage apparatus has a forwardly extending arm pivotably mounted with respect to an axis rigidly affixed to the monoski.

The linkage apparatus may be elastically return biased by an elastic return means positioned between the front portion of the transverse plate and the monoski, or alternatively by an elastic return means positioned between the rear portion of the transverse and the monoski.

The intensity of the return force of the elastic means is preferably defined so as to allow for the displacement of the monoski with the single boot inserted for a mixed walking and sliding motion.

In yet another embodiment, the transverse plate has at the level of each of the its lateral edges a longitudinal edge of a height at most equal to the thickness of the corresponding portion of the boot sole.

The central wedge itself may be constituted by two lateral side plates which are moveably mounted on the transverse plate along a direction transverse to the longitudinal plane of symmetry of the transverse plate. Transverse adjustment means may be provided to allow for adjustment of the spacing of the lateral side plates.

The central wedge itself may, in one embodiment, have a decreasing thickness from the front towards the rear in a longitudinal direction. In another embodiment the central wedge has, in a longitudinal direction, a decreasing height from the front towards the rear.

In yet another embodiment the transverse plate may be configured such that on each side of the central wedge under the central portion of the sole of each boot, a raised portion is provided which is oriented in the longitudinal direction of the sole. Each of the raised portions may be flat, or may be convex in the central zone of each boot along a longitudinal direction.

The linkage apparatus, in another embodiment, is formed of two distinct symmetrical portions with respect to the vertical and longitudinal plane of symmetry of the ski which are positioned transverse to the plane. Each portion comprises a transverse plate to support at least a part of the sole of one boot and a central wedge portion against which the sole of each of the boots is transversely supported towards the interior of the monoski. Each of the plates is connected to the monoski by a pivotably mounted arm with respect to an axis rigidly affixed to the monoski. The two pivot axes are symmetrical with respect to the longitudinal and vertical plane of symmetry of the monoski. Each transverse plate comprises a contact surface at the level of the longitudinal and vertical plane of symmetry of the monoski having a convex cam configuration. Each of the contact surfaces is positioned symmetrically on opposite sides of the plane of symmetry. Each of the arms extends to a pivot point located forwardly of each of the transverse plates and the contact surfaces are positioned at the rear of the transverse plate portions. Alternatively, each of the arms may extend to a pivot point located rearwardly of each of the transverse plates, and the contact surfaces are in this case positioned at the front of the transverse plate portions.

Viewed from a different perspective, the invention is directed to an apparatus allowing for the release of either or both boots from a monoski which apparatus comprises force transmission means for transmitting force from a first boot to a second boot when a force is exerted on the first boot, which force has a component directed towards the second boot. As noted above, anterior retention means for releasably retaining the front portions of the first and second boots, as well as second retention means for retaining the rear end of the boots are provided. The front anterior retention means comprises two front bindings having exterior jaws for retaining each of the boots against exterior movement, and no interior jaws. The force transmissions means comprises a central wedge abutting the inner surfaces of the soles of the first and second boot.

BRIEF DESCRIPTION OF THE DRAWINGS

The invention will be better understood with reference to the annexed drawings given by way of non-limiting example only, in which.

DESCRIPTION OF PREFERRED EMBODIMENTS

One of the aims of the present invention is to propose a safety binding for a monoski which allows for the simultaneous liberation of the two boots when at least one of the boots exerts forces on the binding which retains it which exceed the release threshold. To a large extent, the bindings of the invention are generally traditional front and rear binding elements, or at least independent binding elements which have their own energy and their own release threshold.

Another aim of the invention is to propose a monoski safety binding whose front and rear bindings are mounted on the monoski at their normal locations, or at least which do not need to be displaced, if they are already installed on the monoski.

The safety binding for two ski shoes or boots on a monoski according to the invention comprises first anterior retention means adapted to retain the front of each boot towards the top and exterior of the monoski and to free each front, at least laterally, when an excessive force is exerted by one of the boots on these first retention means. It further comprises second retention means at the rear end of the boots which are adapted to retain the rear of the boots and to free the boots in case of excessive force being exerted.

Figure 1:
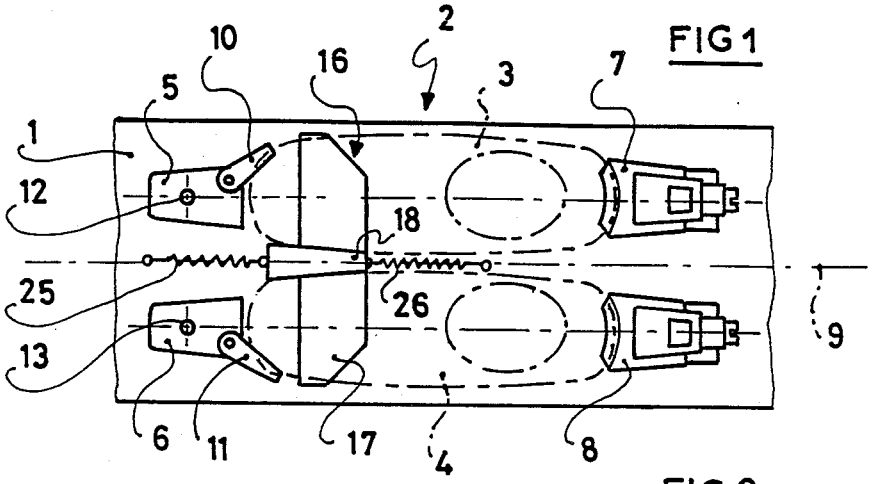
FIG. 1 is a schematic top view of the safety binding according to the invention mounted on a monoski.
Figure 2:
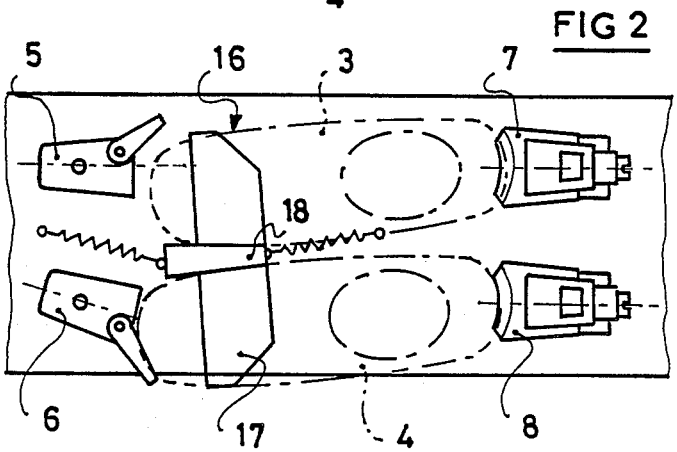
FIG. 2 illustrates one of the release modes of the safety binding of FIG. 1.
Figure 3:
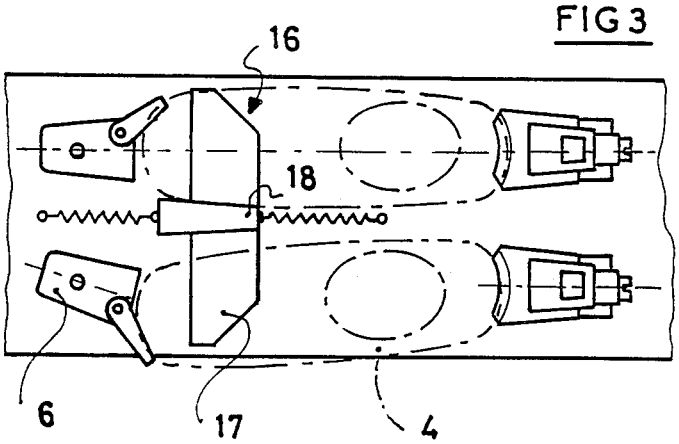
FIG. 3 illustrates another release mode of the safety binding of FIG. 1.
Figure 4:
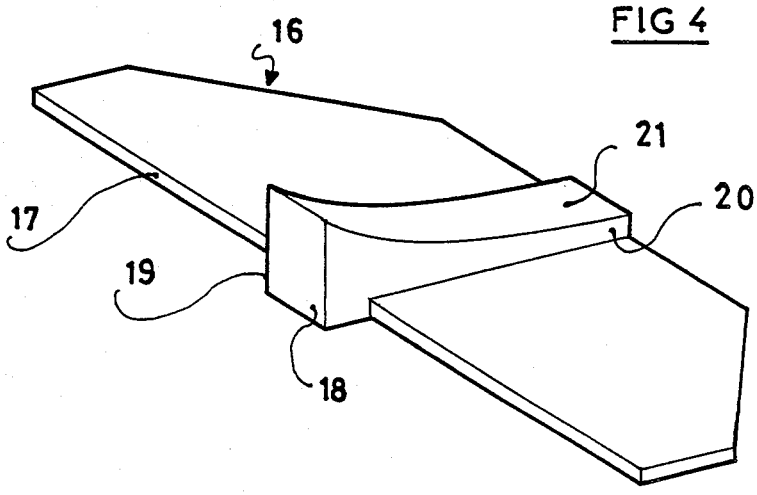
FIG. 4 is a perspective view of the linkage apparatus shown in FIGS. 1–3.
Figure 5:
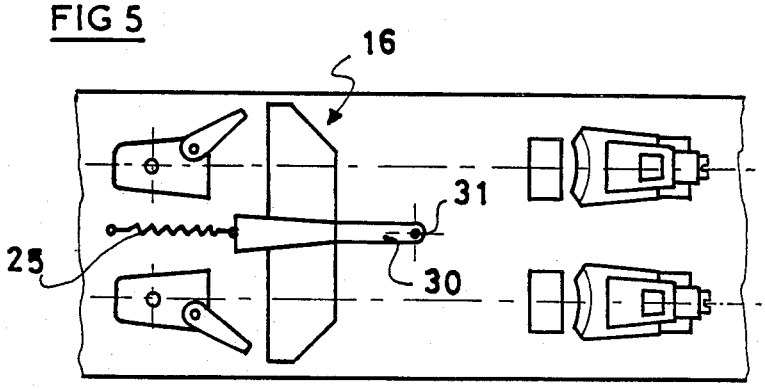
FIG. 5 shows, in schematic top view, an alternative embodiment of the safety binding according to the invention.
Figure 6:
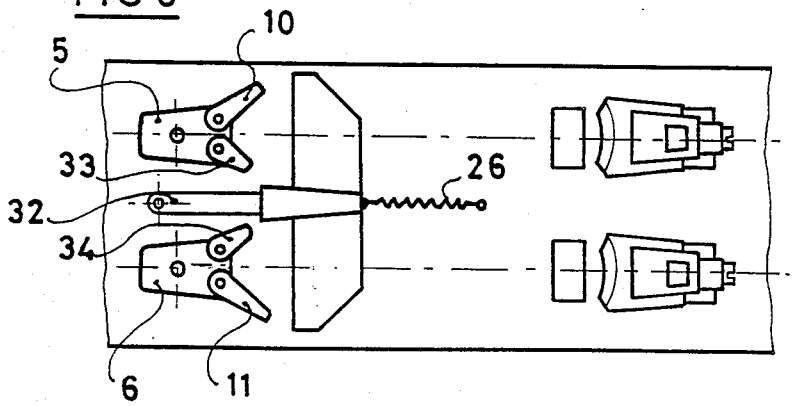
FIG. 6 is a top schematic view of another alternative embodiment according to the invention.
Figure 7:
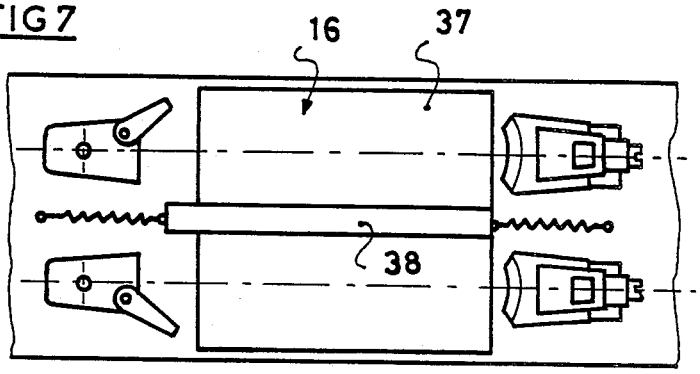
FIG. 7 is a top schematic view which illustrates another embodiment of the invention.
Figure 8:
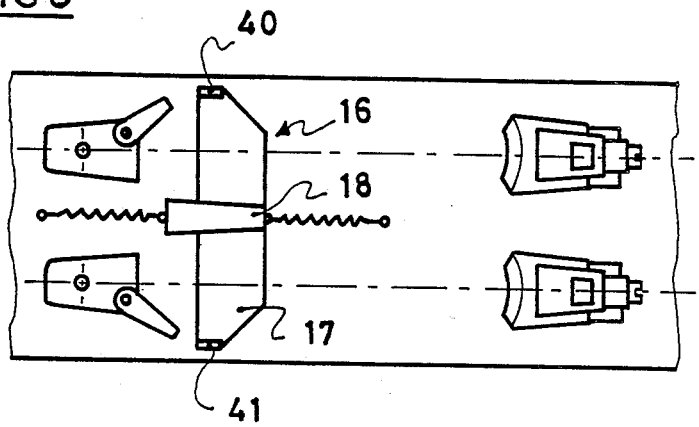
FIG. 8 is a top view showing yet another embodiment of the invention.
Figure 9:
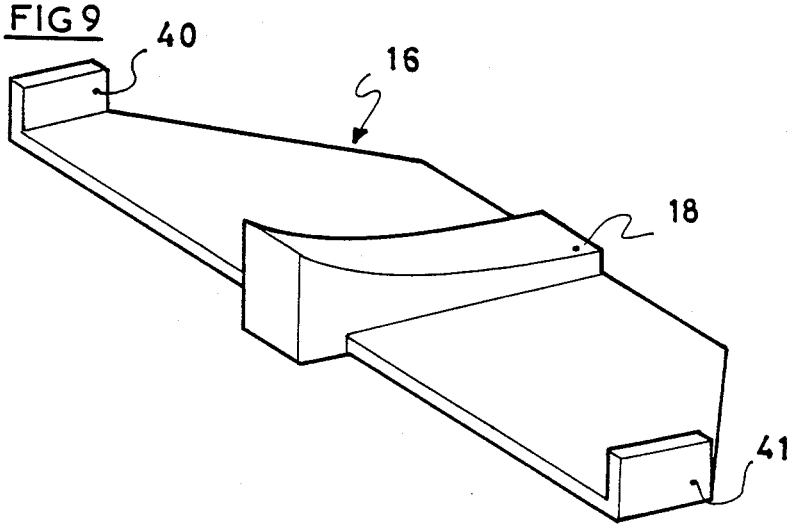
FIG. 9 is a perspective view showing the linkage apparatus of FIG. 8.
Figure 10:
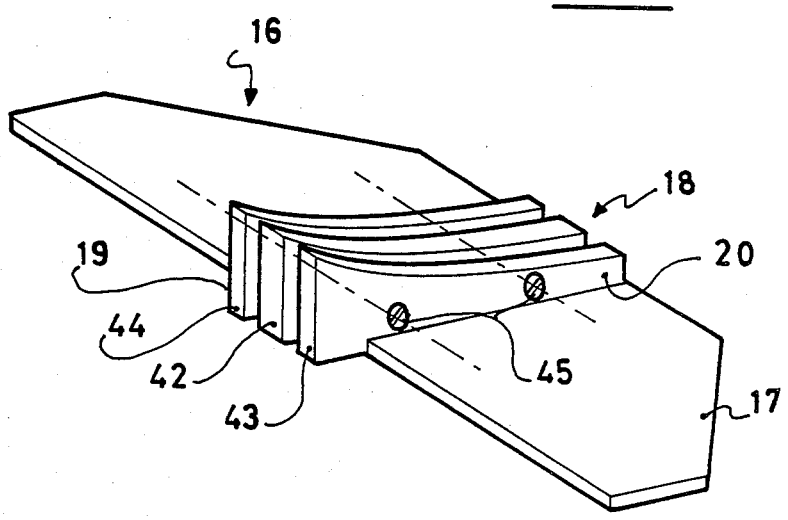
FIG. 10 is a perspective view showing an alternative linkage apparatus.
Figure 11:
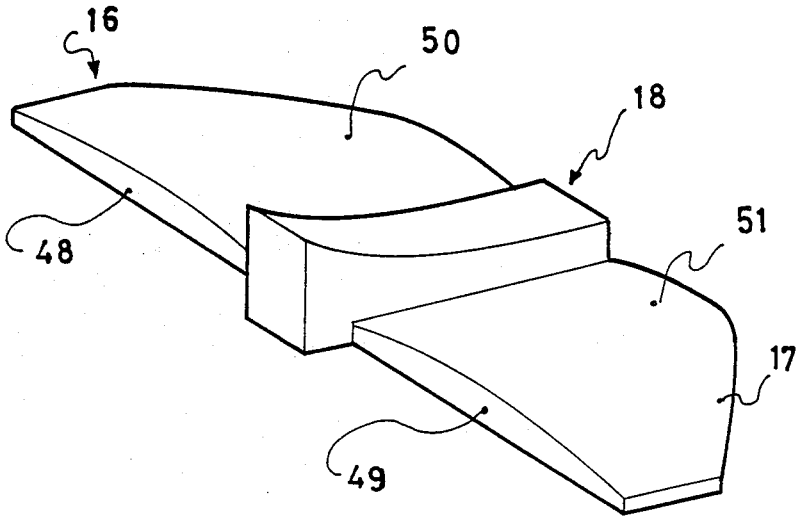
FIG. 11 is a perspective view showing an alternative linkage apparatus.
Figure 12:
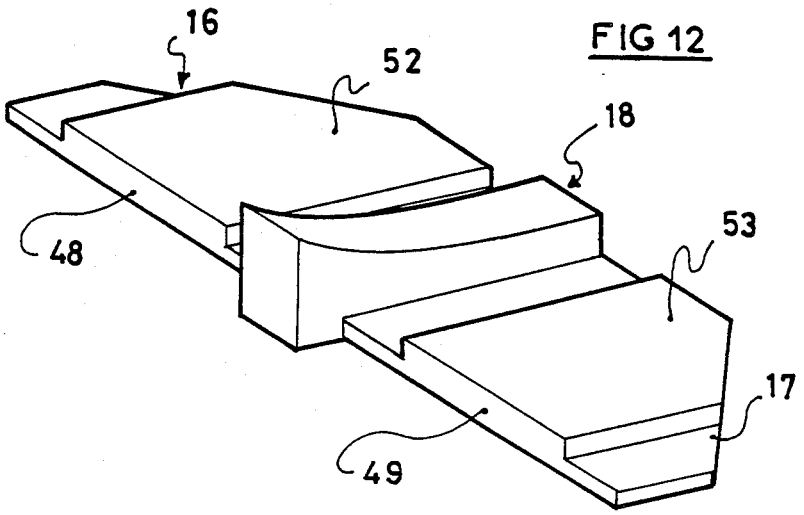
FIG. 12 illustrates in perspective yet another alternative linkage apparatus.

The inventive apparatus is further characterized in that it comprises a transverse linkage apparatus for the boots which comprises:

FIGS. 11 and 12 illustrate two alternative embodiments of linkage apparatus 16, and more precisely of transverse plate 17. According to these alternatives, portions 48 and 49 of transverse plates 17 which are situated on both sides of central wedge 18 have in the central zone of the sole of each boot a raised portion which is oriented along a longitudinal direction.

Thus, FIG. 11 exposes on each side of central wedge 18, two upwardly curved convex surfaces 50 and 51 of transverse plate 17, the center raised portion of each curved surface being situated substantially in the vicinity of the sole.

FIG. 12 has on each side of central wedge 18, two raised portions 52 and 53 which are longitudinally directed and which project above the upper surface of transverse plate 17.

It must be emphasized that raised portions 50, 51, 52 and 53 reach a level in height which is less than the level of the upper surface of central wedge 18.

Figure 13:
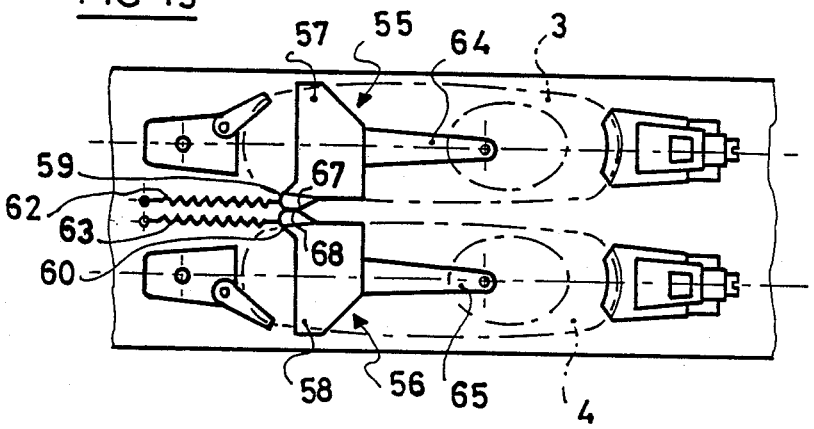
FIG. 13 is a top view schematically showing an alternative safety binding according to the invention.
Figure 14:
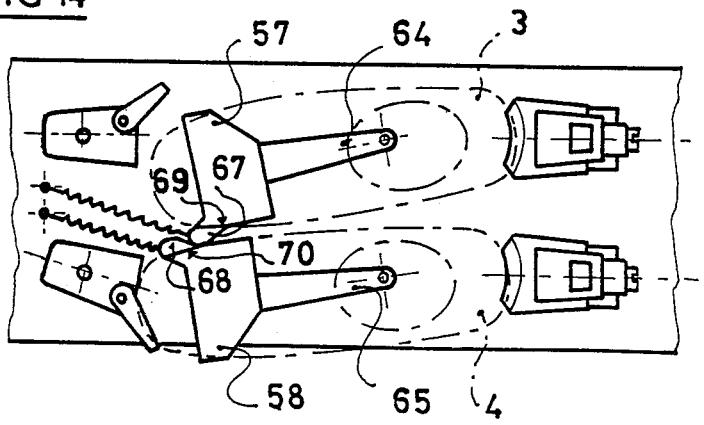
FIG. 14 illustrates the operation of the apparatus of FIG. 13.

FIGS. 13 and 14 illustrate another binding variation according to the invention, more specifically with respect to linkage apparatus 16.

According to this alternative, the linkage apparatus comprises two portions 55 and 56 which, in the normal skiing position, are symmetrical with respect to the longitudinal and vertical plane of symmetry of the monoski. These two portions 55 and 56 are positioned against one another in this plane of symmetry.

Each portion 55, 56 has a plate portion 57, 58 on which the sole of the boot rests. Furthermore, each portion 55 and 56 comprises a central wedge portion 59, 60. Towards the exterior, each central wedge has a surface which contacts the boot, and towards the interior it has a contact surface with the other central wedge portion.

FIG. 13 illustrates furthermore that each portion 55 and 56 of the linkage apparatus is extended towards the rear by an arm 64, 65 journalled with respect to a pivot rigidly affixed to the ski. Towards the front each portion 55 and 56 is connected to the monoski by a return spring 62, 63. Naturally, any other mode of linkage of the two portions 55 and 56 to the monoski may be used.

Preferably, contact surfaces 67 and 68 are raised portions having a convex cam configuration, and the zone in which they are in contact with one another is substantially a point.

Furthermore, preferably the lateral sides 19 and 20 of each central wedge portion 59, 60 have towards the rear a tapered zone 69, 70, with the two tapered zones 69 and 70 converging towards one another at their contact point.

FIG. 14 illustrates the movement of these cams during a lateral release of the two boots wherein boot 4 is biased towards the exterior of the monoski by movement of boot 3. In this case, cam-shaped surface 69, while exerting a pressure on the other surface 68, engages and slides along this other surface. On the rear, boot sole 3 comes into contact with bevelled zone 69 of wedge portion 67. As a result, interior boot 3 pivots more than exterior boot 4.

Such an arrangement is preferable because it accelerates the liberation of the interior boot, and it corrects for the fact that the interior boot is disengaged only after release of the exterior boot.

Figure 15:
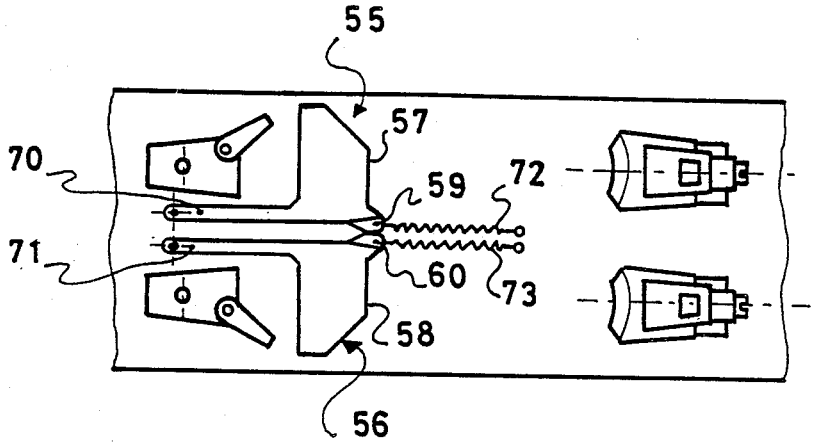
FIG. 15 illustrates an alternative embodiment to that of FIG. 13.

FIG. 15 illustrates an alternative embodiment in which linkage arms 70 and 71 which connect the central wedge portions 59 and 60 to the monoski are positioned in front of the linkage apparatus. As a result, the arc which each portion of the central wedge 59 and 60 describes as it is moved is centered in front of the wedge portions.

The return of arms 70 and 71 into the centered position is assured by any appropriate means such as, for example, by springs 72 and 73, or by torsion springs mounted on each journal axis (not shown).

Naturally, the instant invention is given only by way of non-limiting example and is not intended to be limited to the particular means, materials and embodiments disclosed, but extends to all equivalents within the scope of the claims.

What is claimed is:

1. Safety binding for securing two boots on a monoski comprising anterior retention means for retaining the front of each boot upwardly and exteriorly of said monoski and for freeing each front at least laterally when an excessive force is exerted by one of said boots on said anterior retention means, and posterior retention means for retaining the rear of each boot on said monoski, wherein said binding further comprises a transverse linkage apparatus for linking said boots comprising:

a central projecting wedge having a width substantially equal to the interior spacing of the soles of said boots in the position where said boots are inserted on said monoski, whereby each said boot is retained at its front end against movement in a transverse direction towards the exterior of said monoski by said anterior retention means, and towards the interior by said central wedge; and means for mounting said wedge for transverse movement relative to said monoski;

whereby movement of either of said two boots interiorly toward the other of said two boots, results in movement of said wedge and said other of said two boots.

2. The safety binding as defined by claim 1 wherein said binding further comprises second retention means for retaining the rear ends of said boots for freeing the rear ends of said boots in case of excessive force.

3. The safety binding as defined by claim 1 wherein said first anterior retention means comprises, for each of said boots, front vertical retention means and exterior lateral retention means, the lateral retention means, the lateral retention towards the interior being assured by the central wedge of the linkage apparatus.

4. The safety binding as defined by claim 1 further comprising elastic return means for elastically returning the linkage apparatus to the centered position on the monoski.

5. The safety binding as defined by claim 4 wherein the intensity of the return force of the elastic means is defined so as to allow for the displacement of the monoski with a single boot inserted for a mixed walking and sliding motion.

6. The safety binding as defined by claim 1 wherein the central wedge has in a longitudinal direction a decreasing thickness from the front towards the rear.

7. The safety binding as defined by claim 1 wherein the central wedge has in a longitudinal direction a decreasing height from the front towards the rear.

8. The safety binding as defined by claim 1 wherein the linkage apparatus is formed of two distinct symmetrical portions with respect to the vertical and longitudinal plane of symmetry of the ski which are positioned transverse to the said plane, each portion comprising a transverse plate to support at least a part of the sole of one boot and a central wedge portion against which the sole of each of said boots is transversely supported towards the interior of the monoski.

9. The safety binding as defined by claim 8 wherein each of said plates is connected to the monoski by a pivotably mounted arm with respect to an axis rigidly affixed to the monoski, and that the two pivot axes are symmetrical with respect to the longitudinal and vertical plane of symmetry of the monoski.

10. The safety binding as defined by claim 9 wherein each transverse plate comprises a contact surface at the level of the longitudinal and vertical plane of symmetry of the monoski, having a convex cam configuration, each of said contact surfaces being positioned symmetrically on opposite sides of said plane of symmetry.

11. The safety binding as defined by claim 10 wherein each of said arms extends to a pivot point located forwardly of each of said transverse plates and wherein said contact surfaces are positioned at the rear of said transverse plate portions.

12. The safety binding as defined by claim 10 wherein each of said arms extends to a pivot point located rearwardly of each of said transverse plates and wherein said contact surfaces are positioned at the front of said transverse plate portions.

13. The safety binding as defined by claim 1 wherein, via said central wedge, said interiorly directed transverse force transmitted by either of said two boots results in an exteriorly directed force being exerted on the other of said two boots away from said either of said two boots.

14. A safety binding for securing two boots on a monoski comprising first anterior retention means for retaining the front of each boot towards the top and exterior of said monoski and for freeing each front at least laterally when an excessive force is exerted by one of said boots on said first anterior retention means, wherein said binding further comprises a transverse linkage apparatus for linking said boots comprising:

a central projecting wedge having a width substantially equal to the interior spacing of the soles of said boots in the position where said boots are inserted on said monoski, whereby each said boot is retained at the level of its front end along a transverse direction towards the exterior of said monoski by said first retention means, and towards the interior by said central wedge which further transmits to the other boot front an interiorly directed transverse force, wherein said linkage apparatus further comprises a transverse plate on which rests at least the front portion of each of said boots, the said transverse plate itself being adapted to rest on the upper surface of said monoski and being movable on the upper surface of said monoski at least one direction component transverse to the longitudinal axis of said monoski.

15. The safety binding as defined by claim 14 wherein said central wedge is rigidly affixed to the upper surface of said transverse plate along its longitudinal and vertical median plane.

16. The safety binding as defined by claim 15 wherein said transverse plate extends under the front portion of the sole of each of said boots.

17. The safety binding as defined by claim 15 wherein said transverse plate extends under the boot from the front to the rear portion of the sole of each of said boots.

18. The safety binding as defined by claim 15 wherein said transverse plate of the linkage apparatus has a rearwardly extending arm pivotably mounted with respect to an axis rigidly affixed to the monoski.

19. The safety binding as defined by claim 15 wherein said transverse plate of the linkage apparatus has a forwardly extending arm pivotably mounted with respect to an axis rigidly affixed to the monoski.

20. The safety binding as defined by claim 15 wherein said linkage apparatus is elastically return biased by an elastic return means positioned between the front portion of the transverse plate and the monoski.

21. The safety binding as defined by claim 15 wherein the linkage apparatus is elastically returned by an elastic return means positioned between the rear portion of the transverse plate and the monoski.

22. The safety binding as defined by claim 15 wherein said transverse plate has at the level of each of its lateral edges a longitudinal edge of a height at most equal to the thickness of the corresponding portion of the boot sole.

23. The safety binding as defined by claim 15 wherein the central wedge is constituted by two lateral side plates which are moveably mounted on the transverse plate along a direction transverse to the longitudinal plane of symmetry of the transverse plate.

24. The safety binding as defined by claim 23 further comprising transverse adjustment means to allow for adjustment of the spacing of the lateral side plates.

25. The safety binding as defined by claim 15 wherein the transverse plate has on each side of the central wedge under the central portion of the sole of each boot a raised portion oriented in the longitudinal direction of the sole.

26. The safety binding as defined by claim 25 wherein each of said raised portions is flat.

27. The safety binding as defined by claim 25 wherein each of said raised portions is convex in the central zone of each boot along a longitudinal direction.

28. A safety apparatus allowing for the release of either or both boots from a monoski, said apparatus comprising means for transmitting force from a first boot to a second boot when a force is exerted on said first boot, which force has a component directed towards said second boot, said apparatus further comprising anterior retention means for releasably retaining the front portions of said first and second boots in position on said monoski, wherein said anterior retention means comprises two front bindings having exterior jaws for retaining each of said boots against exterior movement, and no interior jaws, wherein said force transmission means comprises a central wedge abutting the inner surfaces of the soles of said first and second boots, and wherein said central wedge is constituted by two lateral side plates which are movably mounted on said transverse plate along the direction transverse to the longitudinal plane of symmetry of said transverse plate.

29. The apparatus as defined by claim 28 further comprising transverse adjustment means to allow for adjustment of the spacing of the lateral side plates.

30. A safety apparatus allowing for the release of either one or two boots from a monoski, said apparatus comprising:

means for releasably retaining a first boot and a second boot upon said monoski;

means located between said first boot and said second boot for transmitting a force from said first boot to said second boot in response to a force being exerted by said first boot, which force has a component directed towards said second boot, which force tends to release said second boot from said means for retaining said second boot; and wherein said means for transmitting said force further comprises means for reducing resistance of one of said first boot and said second boot to movement, in response to movement of the other of said first boot and said second boot.

31. The apparatus as defined by claim 30 wherein said means for reducing resistance comprises means for reducing a threshold release force of each of said two boots from a first predetermined value to a second, lesser, predetermined value in response to the other of said two boots having first released from said monoski.

32. The apparatus as defined by claim 31 wherein said means for reducing comprises an element for laterally abutting an interior portion of each of said boots.

33. The apparatus as defined by claim 30 wherein said means for releasably retaining said first boot and said second boot comprises anterior retention means for releasably retaining the front portions of said first and second boots in position on said monoski.

34. The apparatus as defined by claim 33 wherein said anterior retention means comprises two front bindings having exterior jaws for retaining each of said boots against exterior movement, and no interior jaws.

35. The apparatus as defined by claim 34 wherein said force transmission means comprises a central wedge abutting the inner surfaces of the soles of said first and second boots.

36. The apparatus as defined by claim 35 wherein the thickness of said central wedge decreases in the longitudinal direction towards the rear.

37. The apparatus as defined by claim 35 wherein said central wedge decreases in height from the front to the rear in a longitudinal direction.

38. The apparatus as defined by claim 37 wherein each of said raised portions is flat.

39. The apparatus as defined by claim 37 wherein each of said raised portions is convex in the central zone of each boot along a longitudinal direction.

40. The apparatus as defined by claim 35 wherein said central wedge has a width substantially equal to the interior spacing of the soles of said ski boots.

41. The apparatus as defined by claim 40 wherein said central wedge assures the interior retention of each of said first and second boots.

42. The apparatus as defined by claim 35 wherein said force transmission means further comprises a transverse plate on which rests at least the front portion of said first and second boots.

43. The apparatus as defined by claim 42 wherein said transverse plate extends under the front portion of the sole of each of said first and second boots.

44. The apparatus as defined by claim 42 wherein said transverse plate extends from the front to the rear portion of the sole of each of said first and second boots.

45. The apparatus as defined by claim 42 wherein said force transmission means has a rearwardly extending arm pivotably mounted with respect to one axis rigidly affixed to the monoski.

46. The apparatus as defined by claim 42 wherein said transverse plate has a forwardly extending arm pivotably mounted with respect to an axis rigidly affixed to the monoski.

47. The apparatus as defined by claim 42 wherein said apparatus is elastically return biased by an elastic return means positioned between the front portion of the transverse plate and the monoski.

48. The apparatus as defined by claim 42 wherein said apparatus is elastically return biased by an elastic return means positioned between a rear portion of the transverse plate and said monoski.

49. The apparatus as defined by claim 48 wherein the intensity of the return force of the elastic return means is defined so as to allow for the displacement of the monoski with the single boot inserted for a mixed walking and sliding motion.

50. The apparatus as defined by claim 42 wherein said transverse plate has at the level of each of its edges a longitudinal edge of a height at most equal to the thickness of the corresponding portion of the boot sole.

51. The apparatus as defined by claim 42 wherein said transverse plate on each side of the central wedge under the central portion of the sole of each of said first and second boots has a raised portion oriented in the longitudinal direction of each of said soles.

52. A safety apparatus allowing for the release of either or both boots from a monoski said apparatus comprising means for transmitting force from a first boot to a second boot when a force is exerted on said first boot, which force has a component directed towards said second boot, said apparatus further comprising anterior retention means for releasably retaining the front portions of said first and second boots in position on said monoski, wherein said anterior retention means comprises two front bindings having exterior jaws for retaining each of said boots against exterior movement, and no interior jaws, wherein said force transmission means comprises a central wedge abutting the inner surfaces of the soles of said first and second boots, wherein said force transmission means further comprises a transverse plate on which rests at least the front portion of said first and second boots, and wherein said transverse plate is adapted to rest on the upper surface of said monoski and is movable on the upper surface of said monoski at least along one direction component transverse to said monoski.

53. The apparatus as defined by claim 52 wherein said central wedge is rigidly affixed to the upper surface of said transverse plate in its longitudinal and vertical median plane.

54. The apparatus as deined by claim 33 wherein said means for releasably retaining said first boot and said second boot comprises second retention means for the rear end of the boots adapted to retain the rear end of said first and second boots and to free them in the case of excessive force.

55. The apparatus as defined by claim 30 further comprising elastic return means for elastically returning the linkage apparatus to the centered position on the monoski.

56. The apparatus as defined by claim 30 further comprising two distinct transverse plates to support at least a part of the sole of each of said boots and a central wedge portion against which the sole of the boot is transversely supported towards the interior of the monoski.

57. The apparatus as defined by claim 56 wherein each of said distinct symmetrical portions is adapted to be connected to the monoski by a pivotably mounted arm with respect to the axis rigidly affixed to the monoski, and wherein each of said two pivot axes are symmetrical with respect to the longitudinal and vertical plane of symmetry of the monoski.

58. The apparatus as defined by claim 57 wherein each of said transverse plate portions comprises a contact surface at the level of the longitudinal and vertical plane of symmetry of the monoski, having a convex cam configuration, each of said contact surfaces being positioned symmetrically on opposite sides of said plane of symmetry.

59. The apparatus as defined by claim 58 wherein each of said arms extends to a pivot point located forwardly of said transverse plate portion and wherein said contact surfaces are positioned at the rear of said transverse plate portions.

60. The apparatus as defined by claim 58 wherein each of said arms extends to a pivot point located rearwardly of said transverse plate portion and wherein said contact surfaces are positioned at the front of said transverse plate portions.

61. A safety binding apparatus for securing a first boot and a second boot on a monoski comprising:

(a) a first binding element for retaining an end of said first boot against release from said apparatus upwardly of said monoski and laterally away from said second boot and for releasing said end of said first boot from said apparatus at least laterally away from said second boot in response to the exertion of a predetermined force by said first boot against said first binding element;

(b) a second binding element for retaining an end of said second boot against release from said apparatus upwardly of said monoski and laterally away from said first boot and for releasing said end of said second boot from said apparatus at least laterally away from said first boot in response to the exertion of a predetermined force by said second boot against said second binding element; and (c) means located between said first boot and said second boot for transmitting a lateral force from said first boot toward said second boot and a lateral force from said second boot toward said first boot for moving one of said boots laterally against and with the other of said boots, wherein said means for transmitting further comprises means for reducing resistance of each of said first boot and said second boot to movement laterally interiorly of said monoski to a lesser, predetermined resistance, in response to lateral exterior movement of the other of said first boot and said second boot.

62. The safety binding apparatus of claim 61 wherein said means comprises a force transmitting member which laterally interiorly abuts a respective interior lateral surface of each of said first boot and said second boot, or a member fixed relative thereto, when said first boot and said second boot are secured on said monoski by said apparatus.

63. The safety binding apparatus of claim 61 wherein said first binding element and said second binding element retain the respective ends of each of said first boot and said second boot against release from said apparatus only upwardly of said monoski and laterally away from the other of said first boot and said second boot.

64. The safety binding apparatus of claim 63 wherein said means for transmitting further comprises means for retaining each of said first boot and said second boot against release from said apparatus laterally toward the other of said first boot and said second boot.

65. The safety binding apparatus of claim 61 wherein said means for transmitting comprises a transverse plate upon which said first boot and said second boot are adapted to be placed, and an upwardly projecting member adapted to be positioned between said first boot and said second boot.

66. The safety binding apparatus of claim 61 wherein said means for retaining comprises a transverse plate upon which said first boot and said second boot are adapted to be placed, and an upwardly projecting member adapted to be positioned between said first boot and said second boot.

67. A safety binding apparatus for securing a first boot and a second boot on a monoski comprising:

(a) a first binding element for retaining an end of said first boot against release from said apparatus upwardly of said monoski and laterally away from said second boot and for releasing said end of said first boot from said apparatus at least laterally away from said second boot in response to the exertion of a predetermined force by said first boot against said first binding element;

(b) a second binding element for retaining an end of said second boot against release from said apparatus upwardly of said monoski and laterally away from said first boot and for releasing said end of said second boot from said apparatus at least laterally away from said first boot in response to the exertion of a predetermined force by said second boot against said second binding element; and (c) means for retaining each of said first boot and said second boot against movement laterally toward the other of said first boot and said second boot in response to a force less than a predetermined interior lateral release threshold force, wherein said means for retaining further comprises means for reducing said predetermined interior lateral release threshold force for one of said first boot and said second boot to a lesser, predetermined force, in response to the release of the other of said first boot and said second boot from said apparatus laterally away from the other of said first boot and said second boot.

68. The safety binding apparatus of claim 67 wherein said means for retaining each of said first boot and said second boot against movement laterally toward the other of said first boot and said second boot comprises a portion of the respective binding element of said other of said first boot and said second boot.

* * * * *